US007563759B2

(12) United States Patent
Rogmann et al.

(10) Patent No.: US 7,563,759 B2
(45) Date of Patent: Jul. 21, 2009

(54) FLOOR CLEANING AND CARE COMPOSITIONS COMPRISING TWO NONIONIC SURFACTANTS

(75) Inventors: Karl-Heinz Rogmann, Ratingen (DE); Nicola Kriens, Bochum (DE); Heiko Faubel, Wermelskirchen (DE)

(73) Assignee: Ecolab Inc., Saint Paul, MN (US)

( * ) Notice: Subject to any disclaimer, the term of this patent is extended or adjusted under 35 U.S.C. 154(b) by 735 days.

(21) Appl. No.: 10/518,672

(22) PCT Filed: Jun. 20, 2003

(86) PCT No.: PCT/EP03/06497

§ 371 (c)(1),
(2), (4) Date: Jan. 11, 2005

(87) PCT Pub. No.: WO2004/003122

PCT Pub. Date: Jan. 8, 2004

(65) Prior Publication Data

US 2008/0188389 A1 Aug. 7, 2008

(30) Foreign Application Priority Data

Jun. 29, 2002 (DE) ..... 102 29 421.6

(51) Int. Cl.
*C11D 1/72* (2006.01)
*C11D 1/722* (2006.01)
*C11D 1/825* (2006.01)
*C11D 3/43* (2006.01)

(52) U.S. Cl. ..... 510/421; 510/199; 510/214; 510/240; 510/475; 510/505

(58) Field of Classification Search ..... 510/199, 510/214, 240, 421, 475, 505
See application file for complete search history.

(56) References Cited

U.S. PATENT DOCUMENTS

| | | | | |
|---|---|---|---|---|
| 5,858,956 | A | 1/1999 | Mertens | |
| 6,255,269 | B1 | 7/2001 | Leonard | |
| 6,660,706 | B1 * | 12/2003 | Koester et al. | 510/423 |

FOREIGN PATENT DOCUMENTS

| | | | |
|---|---|---|---|
| DE | 4404199 | | 8/1995 |
| DE | 19856727 | * | 6/2000 |
| EP | 0328174 | | 8/1989 |
| EP | 0743359 | | 11/1996 |
| EP | 0916717 | | 5/1999 |
| WO | WO96/10069 | | 4/1996 |

OTHER PUBLICATIONS

Section Ch, Week 199120, Derwent Publications Ltd., London, GB; AN 1991-144025 XP002254013 & JP03079700, Apr. 4, 1991, 1 page.

* cited by examiner

*Primary Examiner*—Brian P Mruk
(74) *Attorney, Agent, or Firm*—Fredrikson & Byron, PA

(57) ABSTRACT

Aqueous floor cleaning and/or care composition, containing, based on the total composition, at least 3% by weight of a nonionic surfactant of formula I:

(I)

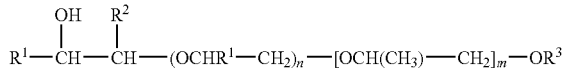

wherein $R^1$ represents hydrogen or an alkyl radical having 1 to 18 C atoms, and $R^2$, independently of $R^1$, represents hydrogen or an alkyl radical having 1 to 18 C atoms, and the sum of the C atoms present overall in $R^1$ and $R^2$ is between 6 and 18, and $R^3$ represents an alkyl radical having 4 to 18 C atoms, and $R^4$ hydrogen or an alkyl radical having 1 to 6 C atoms and n is a number from 1 to 30 and m a number from 0 to 5.

13 Claims, No Drawings

FLOOR CLEANING AND CARE COMPOSITIONS COMPRISING TWO NONIONIC SURFACTANTS

The present invention relates to aqueous floor cleaning and/or floor care compositions containing one or more particular nonionic surfactants and to the use of said compositions for the cleaning and/or care of floors.

Floor coverings may be finished with polymer films in the factory, subsequently treated using polymer-containing care compositions, or else left untreated.

All of these surfaces may be prone to soiling, even and particularly if glossy surfaces are involved. Contaminants, dust particles and also residues of the surface-drying cleaning liquor may be made more visible and an unattractive overall image may be created.

To solve the problem, attempts are made to remove dust and lightly adhering soil from said surfaces. This is carried out normally by cleaning by the so-called wet-wipe method with mist-wet textile fabrics or nonwovens, without damage to the surface occurring.

In practice, however, other kinds of soil also occur, which adhere more strongly or else, for example, are introduced during bad weather. Such soil may be removed only by wet wiping with cleaning textiles with the use of cleaning compositions. The surface is wetted by the cleaning compositions and the soil emulsified or dispersed.

A sufficient amount of cleaning liquor on the floor ensures the correct removal of the emulsified or dispersed soil. During wet wiping, however, a fairly large amount of residual moisture also remains on the floor covering.

Depending on the cleaning composition chosen, this can lead to visible residues on the surfaces. Accordingly care has to be taken in the selection of cleaning compositions so that, when they are used, the fewest possible residues, if any, remain on the floor surfaces.

A further criterion in the selection of the suitable cleaning composition is the wettability of surfaces. Depending on the floor covering, which as explained above may be provided with polymer films, treated subsequently with polymer-containing care compositions or else left untreated, even after polishing action where appropriate, the surfaces exhibit different surface properties.

With an addition of 0.5 to 1 g of surfactant per liter of cleaning liquor, which is conventional in practice, the wettability is not satisfactory with many commercial cleaning compositions. When such cleaning compositions are used, it is frequently observed that the film of liquid breaks up and islands of liquid with different liquid layer thicknesses are formed on the floor surface. After drying, precisely said islands become visible in most cases, because of the cleaning composition components left behind. The resulting patchy appearance of the surface is rated a distinct disadvantage of the corresponding cleaning compositions in practice.

In view of the practical problems described above, the cleaning power, the wettability and (in the case of glossy surfaces) the reduction in the gloss after the drying are important criteria in evaluating the quality of floor cleaning and/or floor care compositions.

A further requirement, if aqueous floor cleaning and/or floor care compositions are used in so-called abrasion-suction machines or automatic cleaning units, is that the compositions must exhibit a low foam stability and a low foam level, as otherwise the cleaning process will be interrupted by disconnection of the equipment.

It may be stated by way of explanation here that, through the use of strongly foaming cleaning compositions, a foam cushion is formed in the dirty water tank. The float in the dirty water tank is thereby raised above the actual liquid level. Depending on the foam strength, this can lead to the disconnection mechanism being activated.

Manual cleaning compositions which are commercially available nowadays usually contain combinations of anionic and/or nonionic surfactants and in some cases combinations with amphoteric surfactants as a surfactant base. When they are used in the above-mentioned automatic cleaning units, the formulator of cleaning compositions uses preferably, if not exclusively, surface-active compounds from the group of the nonionic surfactants. The reason is mainly in the fact that the anionic surfactants involved, which are used in formulations for manual use, are not considered because of their strong foam-forming properties. Accordingly the formulator must of necessity resort to less markedly foaming nonionic surfactants. Moreover, the developer has been obliged in the past to accept other deficiencies in use, in particular as regards the cleaning performance.

The object of the present invention is accordingly to develop floor cleaning and/or care compositions which may be used without difficulty both manually and in automatic cleaning units, and whose cleaning performance is to be comparable with that of the known compositions based on anionic surfactants.

Accordingly the present invention relates to aqueous floor cleaning and/or floor care compositions containing, based on the total composition, at least 3% by weight of a nonionic surfactant of formula I:

$$R^1-\underset{}{\overset{OH}{\overset{|}{CH}}}-\overset{R^2}{\overset{|}{CH}}-(OCHR^1-CH_2)_n-[OCH(CH_3)-CH_2]_m-OR^3 \quad \text{(I)}$$

wherein $R^1$ represents hydrogen or an alkyl radical having 1 to 18 C atoms, and $R^2$ independently of $R^1$ represents hydrogen or an alkyl radical having 1 to 8 C atoms, and the sum of the C atoms present overall in $R^1$ and $R^2$ is between 6 and 18, and $R^3$ represents an alkyl radical having 4 to 18 C atoms, and $R^4$ hydrogen or an alkyl radical having 1 to 6 C atoms and n is a number from 1 to 30 and m a number from 0 to 5. It may also be mentioned at this point that n and m normally represent average degrees of ethoxylation or propoxylation.

In a preferred embodiment, the composition according to the invention contains less than 3% by weight, preferably less than 1% by weight of anionic surfactants, based on the total composition, it being particularly preferred that substantially no anionic surfactants at all are present. The absence of anionic surfactants in the context of the present invention means that anionic surfactants are not added intentionally during the formulation of suitable compositions. It cannot be excluded, however, that anionic surfactants may nevertheless enter the composition according to the invention in small amounts through other raw materials or impurities.

It is further preferred that the composition according to the invention includes at least one further nonionic surfactant which does not come under formula I. Particularly preferably the above-mentioned further nonionic surfactant is selected from the compounds of formula II:

$$R^5-CH_2-CH_2-(OCH_2-CH_2)_n-[OCH(CH_3)-CH_2]_m-[OBu]_l-O\,R^6 \quad \text{(II)}$$

wherein $R^5$ represents an alkyl radical having 6 to 18 C atoms, and $R^6$ represents hydrogen or an alkyl radical having 1 to 6 C atoms, and the mean degree of ethoxylation n is a number from 1 to 30, the mean degree of propoxylation m a number from 0 to 5, and the mean degree of butoxylation l a number from 0 to 5, preferably 1 to 4.

In the context of the present invention, Bu in formula II refers to butyl, in particular for example in a form such as is present in commercial products, for example Plurafac® 221, which is available from BASF.

Most particularly preferred are compositions according to the invention which contain a nonionic surfactant according to formula II, on condition that $R^6$ is hydrogen and m is 0.

In a further preferred embodiment of the composition according to the invention, in the composition, the above-mentioned nonionic surfactant of formula I amounts to at least a third of and at most twice the weight of the other nonionic surfactant preferably included according to the invention. It is further most particularly preferred if, in the composition according to the invention the amount by weight of the above-mentioned nonionic surfactant of formula I is at least half as great as, but not greater than, the amount by weight of the other nonionic surfactant preferably included according to the invention.

It is further preferred that, based on the total composition, the total amount of the above-mentioned nonionic surfactant of formula I and, if present, the other nonionic surfactant preferably included according to the invention is 5 to 35% by weight, preferably 7 to 20% by weight.

Further preferred surface-active components include amine oxide derivatives, it being particularly preferred that the amine oxide derivative represents a tri-alkylamine oxide having one alkyl radical containing 8 to 20 carbon atoms and two alkyl radicals containing a smaller number of carbon atoms in the alkyl chain, wherein the two shorter alkyl radicals may be the same or different, it being most particularly preferred that the amine oxide derivative is tallow fat-bis-(2-hydroxyethyl)-amine oxide, oleyl-bis-(2-hydroxyethyl-)-amine oxide, coconut-bis-(2-hydroxyethyl)-amine oxide, tetradecyldimethyl-amine oxide and/or alkyl-dimethyl-amine oxide which comprises 12 to 18 carbon atoms in the alkyl chain.

Additional preferred surface-active components are selected from the groups comprising cationic, nonionic, amphoteric surfactants, protein hydrolysates, silicone compounds and phosphoric acid esters and their salts.

Alkylpolyglucosides, which may normally be obtained on a large scale by the condensation of fatty alcohols with glucose or polyglucose and are commercially available in diverse forms, may also be used as additional nonionic surfactants in the compositions according to the invention. Examples of alkylpolyglucosides that are suitable for the use according to the invention are the products Glukopon® 600 from Henkel and Triton®BG10 from Röhm & Haas. Other alkoxylated alkyl alcohols that do not come under the compounds defined in formulas I and II may additionally be used as nonionic surfactants in the compositions according to the invention.

Other surfactant compounds preferably contained in the compositions according to the invention are those from the class of phosphoric acid esters, which preferably include at least one salt of a phosphoric acid partial ester, wherein particularly preferably at least one alkali metal salt of a phosphoric acid partial ester of alkoxylated alkyl phenol is present.

The phosphoric acid esters are surfactant substances that are preferably derived from long-chain aliphatic or araliphatic alcohols. The salts of phosphoric acid partial esters, and here in particular those of alkoxylated alkyl phenols, have provided to be particularly suitable. Preferred alkali metal salts are the sodium and potassium salts, of which in turn the potassium salts are particularly preferred. Phosphoric acid partial esters with a surfactant effect, such as are preferably used according to the invention, are commercially available. An example of an active ingredient of this kind that may be used particularly effectively according to the invention is the product Triton® H 66 (Röhm & Haas).

Preferably, the composition according to the invention contains polyethylene glycol and/or polypropylene glycol as an additional component, said polyethylene glycol and/or polypropylene glycol preferably having a molecular weight in the range of 200 to 2000.

It has further proved to be particularly advantageous if the above-mentioned polyethylene glycol and/or polypropylene glycol makes up 0.01 to 5% by weight, particularly preferably 0.05 to 1% by weight, based on the total composition.

The present invention further relates to the use of a composition according to the invention for the cleaning and/or care of floors which are uncoated or finished with a polymer layer.

Preferably the aforementioned composition is diluted with water using a dilution factor of 5 to 5000, in particular 50 to 3500, prior to the use according to the invention for cleaning and/or care.

The compositions according to the invention are characterized in that the same or better cleaning activity is achievable by their use than with compositions that contain more than 3% by weight of anionic surfactants. In addition, very good wetting behavior is observed with the compositions according to the invention, as is otherwise observed only with compositions that contain more than 3% by weight of anionic surfactants.

In addition it may be stated that the residue characteristics and the desired foam profile of the compositions according to the invention are rated equal to or better than the currently commercially available compositions formulated on a pure nonionic surfactant base.

EXAMPLES

1. Production of Test Solutions

The cleaning compositions E1 to E4 according to the invention were produced as in Table 1a and the cleaning compositions V1 to V9 used as a comparison as in Table 1b, by simply combining various individual components.

TABLE 1a

Aqueous cleaning compositions according to the invention with different ingredients (in % by weight)

| Raw materials | E1 | E2 | E3 | E4 |
|---|---|---|---|---|
| Fatty alcohol $C_{12}$-$C_{18}$ EU/BuO adduct | 10.0 | — | 20.0 | 15.0 |
| Alcohol $C_8$-$C_{10}$-1PO-22EO Hydroxydecyl ether | 20.0 | 30.0 | 10.0 | 15.0 |
| Glycol ethers | | | 0-10 | |
| Complexing agents | | | 0.1-1 | |
| Auxiliaries | | | 0-1 | |
| Dyes | | | 0-0.1 | |
| Other auxiliaries | | | 0-8 | |
| Water | | | To 100 | |

TABLE 1b

| Comparison aqueous cleaning compositions with different ingredients (in % by weight) | | | | | | | | | |
|---|---|---|---|---|---|---|---|---|---|
| Raw materials | V1 | V2 | V3 | V4 | V5 | V6 | V7 | V8 | V9 |
| $C_{15}$-alkanesulfonate-Na | 15.0 | 10.0 | — | — | — | — | — | — | — |
| $C_{12}$-$C_{14}$ laurylethersulfate | 15.0 | — | 15.0 | 15.0 | — | — | — | — | — |
| Fatty alcohol $C_8$-$C_{10}$ glucoside | — | 10.0 | — | — | — | — | — | — | — |
| Fatty alcohol $C_{12}$-$C_{18}$ + 10EO | — | 10.0 | — | — | 16.0 | — | 10.0 | 10.0 | — |
| Fatty alcohol $C_{12}$-$C_{14}$ + 4EO | — | — | — | — | 4.0 | — | — | — | — |
| Fatty alcohol $C_{12}$-$C_{14}$ + 5EO + 4PO | — | — | — | 15.0 | — | — | — | — | — |
| Fatty alcohol $C_{12}$-$C_{16}$ polyglycol ether | — | — | 10.0 | — | 10.0 | — | — | — | — |
| Fatty alcohol $C_{12}$-$C_{15}$ + 1OEO | — | — | — | — | — | — | 10.0 | — | — |
| Isotridecyl alcohol + 8EO | — | — | — | — | — | — | 10.0 | — | 12.0 |
| Oxoalcohol $C_{12}$-$C_{15}$ + 8EO | — | — | — | — | — | 12.0 | — | — | — |
| Dimethyl alkyl $C_{12}$-$C_{14}$ amine oxide | — | — | — | — | — | 6.0 | — | — | 6.0 |
| Oxoalcohol $C_{13}$-$C_{15}$ + 6EO + 2BuO methyl-terminated | — | — | — | — | — | 12.0 | — | — | 12.0 |
| Fatty alcohol $C_{12}$-$C_{15}$ EO/BuO adduct | — | — | — | — | — | — | — | 20.0 | — |
| Alcohol $C_8$-$C_{10}$-1PO-22EO Hydroxydecyl ether | — | — | — | — | — | — | — | — | — |
| Glycol ethers | | | | | 0-10 | | | | |
| Complexing agents | | | | | 0.1-1 | | | | |
| Auxiliaries | | | | | 0-1 | | | | |
| Dyes | | | | | 0.01 | | | | |
| Other auxiliaries | | | | | 0-8 | | | | |
| Water | | | | | to 100 | | | | |

For the experiments in laboratory tests, application solutions of 500 ml were prepared in each case from the cleaning compositions according to Tables 1a and 1b by dilution with water, using a dilution factor of 500, and poured into wide-shaped beakers.

Gardner Cleaning Behavior:

For carrying out the tests on the cleaning behavior of the diluted cleaning compositions according to Tables 1a and 1b, the cleaning composition to be tested is applied to an artificially soiled white PVC strip and a sponge is mechanically moved back an forth. After a particular number of wiping cycles the degree of whiteness of the test strip thus cleaned is measured with a photo-electronic color measuring instrument.

The following units are mentioned as tools for carrying out the tests:

1. Gardner's washability and abrasion tester, model 494 (DIN ASTM-515) Supplier: Erichson GmbH & Co. KG
2. Dr. Lange color difference measuring instrument "Micro Color LM" Supplier: Dr. Lange GmbH
3. Sponge press
4. White PVC film, Benova no. 2211180
5. Rigid PVC strip 40*554*3 mm in size as support
6. Pressure sensitive adhesive J 6251 from Henkel (diluted 1:1 with ethyl acetate)
7. Template of rigid PVC
8. Polyester sponges, 30*45*90 mm, Europor B type, pore count: 40 ppi (pores per inch), crushing edge: 2.6 kPa (DIN 53577) Supplier: Europlastic Pahl & Pahl & Co.
9. Flat paint brush with natural bristles, approx. 55 mm wide for applying the test soil
10. Dial gauges, approx. 12 cm diameter, for weighing the test soil
11. Rubber roller, smooth, 150 mm wide
12. Carpet scissors
13. Disposable syringes
14. Magnetic agitator
15. Laboratory scales, range 2000 g, measuring accuracy 0.01 g The test soil is produced as shown in Table 2 below.

TABLE 2

| Production of the test soil | | |
|---|---|---|
| Raw material | % by weight | Method |
| Myritol 318 | 17.0 | Mix oil and petrol and add specialty black while stirring. Stir for further 8 hours. Stir again after 3 days. After 14 days the test soil is ready for use. 1 hour's stirring time is required before each use. |
| Petrol 80/110 | 36.0 | |
| Telura 310 | 40.0 | |
| Specialty black | 7.0 | |

To prepare the test strips, seven rigid PVC strips are laid immediately adjacent one another so that an area of 280*554 mm is obtained. The strips are provided with pressure sensitive adhesive and left to dry over-night.

The white PVC film coated with the slightly smoother outer side roll upwards is placed on the PVC strips, smoothed and pressed on with the rubber roller, so that a uniform, blister- and fold-free surface is obtained. The test soil is applied as follows:

1. Place the PVC template over the film and the strips.
2. Weigh 2 g of test soil on a dial gauge.
3. Apply the soil to the white PVC film with the flat brush, within the template, first with horizontal and then with vertical brush strokes. Repeat the process several times, ensuring that the last application is at right angles to the abrasion movement.
4. Allow the soil to dry for at least 1 hour.
5. Cut the PVC film along the underlying rigid PVC strips with the carpet scissors.

The cleaning power (CP) is determined as follows: Soak the number of polyester sponges required for the test overnight in tap water.

1. Take a sponge out of the bucket and allow it to drip.
2. Squeeze out the sponge in the squeezing apparatus for 10 seconds.
3. Insert the sponge into the holding device of the Gardner apparatus.
4. Place a soiled test strip in the guide rail of the Gardner apparatus.
5. Locate the guide rail beneath the sponge holder and position the sponge.
6. Apply the required amount of cleaning solution with a graduated beaker. With concentrated products add 6 ml and with diluted products 12 ml to the test strips.
7. Set the automatic counter of the unit to 10 wiping cycles and switch on the Gardner unit.
8. On completion of the wiping cycles, remove the sponge and discard (do not re-use).
9. Remove the test strip from the unit, rinse under running water and allow to dry.
10. Clean six soiled test strips by this method per test solution.
11. The 7th test strip is cleaned only with water as a comparison.

On completion of this test sequence, the degree of whiteness (% CP) is measured as follows:

1. Calibrate the color measuring instrument with an untreated piece of the white PVC film. The reflection is taken as 100%.
2. Measure the reflection at seven different points on each of the six test strips. The mean value of the values found gives the cleaning power in %.

Individual markedly varying values are not included in the calculation.

The mean values from all the measurements are then determined for the solutions investigated:

$$N = \text{number of measured values } (7 * 7 = 49)$$

$$\overline{X} = \frac{\sum^{x}}{N}$$

$$\overline{X} = \text{mean cleaning power}$$

The results determined in this way are contained in Tables 4a and 4b.

Wetting and Residue Behavior:

In addition to the cleaning behavior, laboratory tests were also carried out on the wetting and residue behavior (after drying) using the application solutions prepared by dilution of the cleaning compositions as in Tables 1a and 1b (dilution factor 500).

Test specimens as described after Tables 4a and 4b were prepared for this.

The specimens were then wiped with wiping cloths soaked in application solution and coiled in a figure of eight. The wiping cloths used were lint-free and prewashed and had an area of about 15×15 cm.

Prior to the wiping operation the wiping cloths were soaked in the respective application solution and squeezed manually to the extent that they did not drip.

In order to assess the results after carrying out the wiping tests, the surfaces were inspected using the assessment criteria in Table 3. The results are given in Tables 4a and 4b.

As regards the wetting characteristics, the mean value from five wiping cycles was taken and included as the result in Tables 4a and 4b.

It should be noted that for, evaluation of the residue characteristics, the surfaces were inspected after 10, 20 and 30 wiping cycles, and that the values given in Tables 4a and 4b represent mean values from the three values.

TABLE 3

Assessment criteria for the wetting and residue characteristics after the wiping of surfaces

| Wetting characteristics | | Residue characteristics |
|---|---|---|
| Optimum wetting, even of critical surfaces such as glass | 0 | Uniform drying, no visual impairment of the surfaces (even glass ones) |
| Good wetting of standard surfaces (PVC, linoleum, rubber), but visible wetting problems, particularly in the edge regions of more hydrophobic materials | −1 | Almost uniform drying with some slight exceptions, particularly on high-gloss materials |
| Slight wetting deficiencies on standard coverings (PVC, linoleum, rubber) | −2 | Slight haze formation, particularly in the area of zones with wetting defects on high-gloss surfaces |
| Wetting deficiencies on standard coverings (PVC, linoleum, rubber). Breaking up of the liquid film on more hydrophobic materials | −3 | Slight impairment of the overall picture due to haze, with isolated defects in the area of the zones with wetting problems on all coverings |
| Clear absence of wetting on standard coverings (PVC, linoleum, rubber) | −4 | Visible haze formation, impairment of the overall picture, in particular on high-gloss surfaces |
| Poor wetting, two-dimensional island and droplet formation | −5 | Patchy appearance with visible dulled zones in the area of the island and droplet formation |
| Extreme wetting problems, spontaneous breaking up of the liquid film; formation of islands/drops | −6 | Unsatisfactory appearance, strong patch formation in dull and more glossy zones |

The results of the tests on the cleaning, wetting and residue characteristics are contained in Tables 4a and 4b below.

TABLE 4a

Performance properties of aqueous 0.2% cleaning compositions (see Table 1) based on various evaluation criteria

| | E1 | E2 | E3 | E4 |
|---|---|---|---|---|
| Cleaning performance (Gardner in % CP) | 59 | 62 | 55 | 57 |
| Wetting characteristics | | | | |
| A) | 0 | 0 | 0 | 0 |
| B) | −0.1 | −0.1 | −0.3 | −0.4 |
| C) | −0.2 | −0.2 | −0.3 | −0.3 |
| D) | −0.4 | −0.4 | −0.6 | −0.6 |
| Residue characteristics | | | | |
| E) | −0.5 | −1.0 | −1.0 | 0 |
| F) | −1 | −1.5 | −1.5 | 0 |
| G) | −0.5 | −1.0 | −1.0 | −0.5 |
| H) | −0.5 | −1.5 | −1.5 | −0.5 |
| D) | −1.5 | −2.0 | −2.0 | −1.0 |

TABLE 4b

Performance properties of aqueous 0.2% cleaning compositions (see Table 1) on the basis of various evaluation criteria

| | V1 | V2 | V3 | V4 | V5 | V6 | V7 | V8 | V9 |
|---|---|---|---|---|---|---|---|---|---|
| Cleaning power (Gardner in % CP) | 62 | 51 | 53 | 56 | 44 | 48 | 41 | 44 | 55 |
| Wetting behavior | | | | | | | | | |
| A) | −1.5 | −2.3 | −2.2 | −2.1 | −3.8 | −3.5 | −4.6 | −3.7 | −1.8 |
| B) | −1.6 | −2.7 | −2.8 | −2.6 | −4.2 | −3.9 | −4.8 | −4.0 | −1.9 |
| C) | −1.9 | −2.9 | −3.0 | −2.9 | −4.8 | −4.6 | −5.1 | −4.7 | −2.1 |
| D) | −2.0 | −3.0 | −3.5 | −3.0 | −5.0 | −4.5 | −6.0 | −5.0 | 2.3 |
| Residue behavior | | | | | | | | | |
| E) | −3.0 | −3.0 | −3.0 | −3.0 | −3.5 | −3.0 | −3.5 | −3.0 | −2.0 |
| F) | −3.5 | −4.0 | −3.5 | −3.5 | −4.0 | −3.5 | −4.0 | −3.5 | −2.0 |
| G) | −4.0 | −3.0 | −3.0 | −3.0 | −3.5 | −3.0 | −3.5 | −3.0 | −2.5 |
| H) | −4.5 | −4.0 | −4.0 | −4.0 | −4.0 | −3.5 | −4.0 | −3.5 | −2.5 |
| D) | −5.0 | −4.5 | −4.5 | −5.0 | −4.5 | −4.0 | −4.5 | −4.0 | −2.5 |

Test Specimens for Wetting and Residue Behavior:

PVC, linoleum and rubber as found in conventional floor coverings were used as raw material for the specimens. Specimens with an area of 30 and 60 cm were used for the tests.

Where required by the test program, the specimens were treated with polymer care compositions prior to testing and subjected to high-speed polishing if necessary. In these cases the specimens were produced from 80×200 cm strips: after the required finishing and optionally treatment with the polishing machine, the 30×60 cm specimens were cut from the strips.

As stated, different surfaces were selected for evaluation of the wetting and residue characteristics.

The results in Tables 4a and 4b are accordingly related to the various floor surfaces A to H tested. It will be stated in explanation what is meant by floor surfaces A to H:

A. The tests were carried out on uncoated specimens of PVC, linoleum and rubber. The result in Tables 4a and 4b is a mean value from the respective individual assessments.

B. The tests were carried out on PVC, linoleum and rubber specimens which had each been treated with two films of polyacrylate dispersion. As with A, the result is a mean value.

C. The tests were carried out on PVC, linoleum and rubber specimens which had each been treated with three care films of polyacrylate dispersion and polished twice at high speed. As with A and B, the result corresponds, to a mean value of the results observed.

D. The tests were carried out on a corresponding untreated glass surface.

E. The tests were carried out on uncoated PVC specimens.

F. The tests were carried out on uncoated rubber specimens.

G. The tests were carried out on linoleum specimens which had been treated with two care films of polyacrylate dispersion.

H. The tests were carried out on PVC specimens which had been treated with three care films of polyacrylate dispersion and polished twice at high speed.

The invention claimed is:

1. An aqueous floor composition comprising:

a) at least 3% by weight of a first nonionic surfactant having the formula:

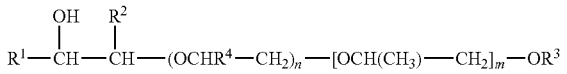

wherein $R^1$ represents hydrogen, $R^2$ represents an alkyl residue having 6 to 18 carbon atoms, $R^3$ represents an alkyl residue having 4 to 18 carbon atoms, and $R^4$ is selected from the group consisting of hydrogen, and an alkyl residue having 1 to 6 carbon atoms, and n is a number from 1 to 30, and m is a number from 0 to 5; and b) a second nonionic surfactant having the formula:

$$R^5—CH_2—CH_2—(OCH_2—CH_2)_n—[OCH(CH_3)—CH_2]_m—[OBu]_l—O\,R^6$$

wherein $R^5$ represents an alkyl residue having 6 to 18 carbon atoms, and $R^6$ is selected from the group consisting of hydrogen and an alkyl residue having 1 to 6 carbon atoms, and the mean degree of ethoxylation n is a number from 1 to 30, the mean degree of propoxylation m is a number from 0 to 5, and the mean degree of butoxylation l is a number from 1 to 4.

2. The composition of claim 1, wherein the composition contains less than 3% by weight of anionic surfactants.

3. The composition of claim 1, wherein $R^6$ is hydrogen and m is 0.

4. The composition of claim 1, wherein the ratio of the first nonionic surfactant to the second nonionic surfactant is 0.3-2.0:1.

5. The composition of claim 1, wherein the total weight of the first nonionic surfactant and the second nonionic surfactant is from about 5 to about 35% by weight.

6. The composition of claim 1, further comprising a glycol selected from the group consisting of polyethylene glycol, polypropylene glycol, and mixtures thereof.

7. The composition of claim 6, wherein the glycol is present from about 0.01 to about 5% by weight.

8. An aqueous floor composition comprising:

a) at least 3% by weight of a first nonionic surfactant having the formula:

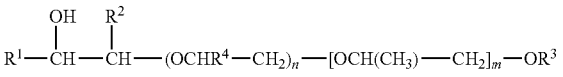

wherein $R^1$ represents an alkyl residue having 1 to 18 carbon atoms, $R^2$ represents an alkyl residue having 1 to 18 carbon atoms, and the sum of total carbon atoms present in $R^1$ and $R^2$ is between 6 and 18, $R^3$ represents an alkyl residue having 4 to 18 carbon atoms, and $R^4$ is selected from the group consisting of hydrogen and an alkyl residue having 1 to 6 carbon atoms, and n is a number from 1 to 30, and m is a number from 0 to 5; and (b) a second nonionic surfactant having the formula:

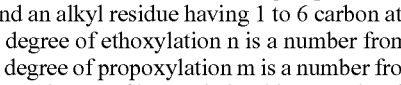

wherein $R^5$ represents an alkyl residue having 6 to 18 carbon atoms and $R^6$ is selected from the group consisting of hydrogen and an alkyl residue having 1 to 6 carbon atoms, and the mean degree of ethoxylation n is a number from 1 to 30, the mean degree of propoxylation m is a number from 0 to 5, and the mean degree of butoxylation l is a number from 1 to 4.

9. The composition of claim 8, wherein the composition contains less than 3% by weight of anionic surfactants.

10. The composition of claim 8, wherein the ratio of the first nonionic surfactant to the second nonionic surfactant is 0.3-2.0:1.

11. The composition of claim 8, wherein the total weight of the first nonionic surfactant and the second nonionic surfactant is from about 5 to about 35% by weight.

12. The composition of claim 8, further comprising a glycol selected from the group consisting of polyethylene glycol, polypropylene glycol, and mixtures thereof.

13. The composition of claim 12, wherein the glycol is present from about 0.01 to about 5% by weight.

* * * * *